US005264111A

United States Patent [19]

Carpenter et al.

[11] Patent Number: 5,264,111

[45] Date of Patent: Nov. 23, 1993

[54] METHODS OF MAKING THIN INSB FILMS

[75] Inventors: Michael K. Carpenter; Mark W. Verbrugge, both of Troy, Mich.

[73] Assignee: General Motors Corporation, Detroit, Mich.

[21] Appl. No.: 926,103

[22] Filed: Aug. 7, 1992

[51] Int. Cl.[5] ..... C25D 3/66

[52] U.S. Cl. ..... 205/232; 204/61; 204/71; 205/230

[58] Field of Search ..... 205/230, 232, 234, 236; 204/59 M, 61, 64 R, 71

[56] References Cited

U.S. PATENT DOCUMENTS

| | | | |
|---|---|---|---|
| 3,879,235 | 4/1975 | Gatos et al. | 148/171 |
| 4,883,567 | 11/1989 | Verbrugge et al. | 204/39 |
| 4,904,355 | 2/1990 | Takahashi | 204/58.5 |
| 5,041,194 | 8/1991 | Mori et al. | 204/58.5 |

OTHER PUBLICATIONS

Lipsztajn et al., "Increased Electrochemical Window in Ambient Temperature Neutral Ionic Liquids," Journal of the Electrochemical Society, 130 (1983) 1968.

Cotton et al., Advanced Inorganic Chemistry, Fifth Edition (1988), pp. 208-211 and pp. 228-231.

Verbrugge et al., "Microelectrode Study of Gallium Deposition from Chlorogallate Melts," AIchE Journal, Jul. 1990, vol. 36, No. 7, pp. 1097-1106.

Lai et al., "Electrodeposition of Aluminium in Aluminium Chloride/1-Methyl-3-Ethylimidazolium Chloride," J. Electroanal. Chem., 248 (1988) pp. 431-432.

Wicelinski et al., "Low Temperature Chlorogallate Molten Salt Systems," Journal of the Electrochemical Society, 134 (1987) 262.

Wilkes et al., "Dialkylimidazolium Chloroaluminate Melts: A New Class of Room-Temperature Ionic Liquids for Electrochemistry, Spectroscopy, and Synthesis," Inorg. Chem. 1982, 21, 1263-1264.

*Primary Examiner*—John Niebling
*Assistant Examiner*—William T. Leader
*Attorney, Agent, or Firm*—Cary W. Brooks

[57] ABSTRACT

A method of electrodepositing a film including the steps of immersing a conductive substrate opposite a counter-electrode in an organochloroindate melt comprising a salt of at least one metal selected from the group consisting of phosphorus, arsenic, and antimony, and an $InCl_3$-dialkylimidazolium chloride wherein the alkyl groups each comprise no more than four carbons, and the molar ratio of the $InCl_3$ to the organic chloride ranges from about 45/55 to $\frac{2}{3}$; and cathodizing said substrate at a potential selected to codeposit In and said metal. In addition, substitution of a small amount of $InCl_3$ with a trichloride salt of another Group III metal can be employed to obtain deposits containing other Group III metals. For molar ratios of the metal salt to $InCl_3$ other than 45/55, the melt is heated to 45° C. or greater.

11 Claims, 3 Drawing Sheets

METHODS OF MAKING THIN INSB FILMS

FIELD OF THE INVENTION

This invention relates to $InCl_3$/1-methyl-3-ethylimidazolium chloride molten salt ($InCl_3$/ImCl), InSb magnetoresistive films made using such salts, and a method of making an InSb film.

BACKGROUND

Magnetoresistive sensors are likely to be important components in automobiles of the 1990's and beyond. These sensors can function as position-sensitive or speed-sensitive devices and will provide the feedback necessary for sophisticated computer-control of engine, transmission and braking functions. The sensors operate by monitoring the resistance of a magnetoresistive element in proximity to a magnet; the resistance of the element depends strongly on the strength and direction of the impinging magnetic field, as well as on the electronic mobility of the element itself. Since the III-V semiconductor indium antimonide (InSb) has the highest carrier mobility of any known semiconductor (77,000 $cm^2$/V.sec for electrons), it is one of the strongest candidates for use as the magnetoresistive element of such sensors.

Magnetoresistive sensors require a relatively thin magnetoresistive element, from 15 μm to 20 nm depending on the specific properties of the film material. Electrodeposition of InSb is potentially a convenient method of obtaining such films since the deposition of any desired film thickness can be easily accomplished by controlling the current or the deposition time or both.

Low-temperature molten salts comprised of aluminum trichloride ($AlCl_3$) and an organic chloride such as 1-butylpyridinium chloride constitute a well-studied class of electrolytes. The reaction by which the melts are formed can be written as $$RCl + AlCl_3 \longleftrightarrow R^+ + AlCl_4^- \quad (1)$$

where RCl is the organic chloride. A wide range of acidities is available in these organic chloroaluminate melts by varying the molar ratio of $AlCl_3$ to organic chloride. Melts with molar ratios less than unity are basic due to the chloride ions from the dissociation of excess organic chloride. For ratios greater than one (excess $AlCl_3$), the corresponding melts have significant Lewis acidity.

Low-temperature melts can be made by using $GaCl_3$, another Group III metal chloride, in place of $AlCl_3$. U.S. Pat. No. 4,883,567, the disclosure of which is hereby incorporated by reference, is directed to the room-temperature electrodeposition of GaAs from such an organic chlorogallate melt containing $GaCl_3$ and 1-methyl-3-ethylimidazolium chloride (ImCl).

While it is likely that InSb can be electrodeposited from either an organic chloroaluminate or chlorogallate molten salt, contamination of the deposit with Al or Ga, respectively, would be likely to occur. Therefore, a melt containing In ions and Sb ions as the only metallic ions would be preferred for InSb electrodeposition.

The electrolyte used in the present invention, the $InCl_3$/1-methyl-3-ethylimidazolium chloride ($InCl_3$/ImCl) molten salt, is a novel material; it has never been prepared before and therefore has never been used as an electrolyte for electrodeposition of any kind. Unlike the $GaCl_3$/ImCl melt which is liquid at room temperature over a range of composition ratios, the $InCl_3$/ImCl melt is liquid at room temperature only at composition ratios very near 45:55 (molar ratio of $InCl_3$ to ImCl)——and even then it is very viscous. Furthermore, if one attempts to prepare the $InCl_3$/ImCl melt exactly as the $GaCl_3$/ImCl melt was prepared in U.S. Pat. No. 4,883,567, by mixing the two solid reactants at room temperature, a sticky mass is obtained rather than a clear liquid. Thus, the reaction of $InCl_3$/ImCl with $SbCl_3$ is not advanced.

While the chemistries of the Group III elements share some similarities, there are also marked differences such that one cannot reliably predict the effect of substituting one element for another in many chemical situations. For example, while Al cannot be electrodeposited from the basic $AlCl_3$/ImCl melt (excess of ImCl), Ga can be deposited from the analogous basic $GaCl_3$/ImCl melt.

One well-known trend in the chemistry of Group III elements is the increasing importance of the univalent oxidation state versus the trivalent oxidation state as the atomic weight increases. Thus the importance of the univalent state is expected to be greater in the chemistry of the heavier In than in the corresponding chemistries of either Al or Ga.

The effects of this relative importance of the In(I) state on the electrodeposition mechanism are not predictable. Thus one might have predicted that In deposition from a melt (such as $InCl_3$/ImCl) would be impossible since the reduction of In(III) might proceed to a stable In(I) species which could not be further reduced (i.e., the organic portion of the melt would be reduced first).

The prior art suggest other notable differences over the present invention which cast doubt on any reasonable expectation of success in electrodeposition of InSb from an $InCl_3$/ImCl and $SbCl_3$ material. Wilkes et al. "Dialkylimidazolium Chloroaluminate Melts:A New Class of Room-Temperature Ionic Liquids for Electrochemistry, Spectroscopy, and Synthesis," Inorg. Chem., 21 (1982) 1263, and Wicelinski et al., "Low Temperature Chlorogallate Molten Salt Systems," J. Electrochemical Society, 134 (1987) 262, disclose that both $AlCl_3$/ImCl and $GaCl_3$/ImCl melts are liquids at room temperature for a relatively wide mole percent of $AlCl_3$ and $GaCl_3$, respectively. Notwithstanding, Wilkes et al., discloses that Al cannot be deposited from such a basic melt (unlike Ga deposition). Lipsztajn et al., "Increased Electrochemical Window in Ambient Temperature Neutral Ionic Liquids," J. Electrochemical Society, 130 (1983) 1968, and Lai, et al. "Electrodeposition of Aluminum in Aluminum Chloride/1-Methy-3-Ethylimidazolium Chloride," J. Electro and I. Chem. 248 (1988) 431, disclose that the reduction leading to Al deposition is by the Al(III) dimer. Verbrugge et al., "Microelectrode Study of Gallium Deposition from Chlorogallate Melts," AICHE Journal 36 (1990) 1097, disclose that the reduction leading to Ga deposition is by the Ga(III) dimer. Cotton et al., "Advanced Inorganic Chemistry," 5th Ed. (1988) discloses: 1) the propensity of Group IIIA elements to exist in the (I) state increases as the group is descended from Al to Tl; 2) Indium dimers containing In(III) are typically unstable in nonaqueous solvents; and 3) Tl(I) dominates thallium chemistry, rather than Tl(III). Thus, the prior art cast considerable doubt that the In(III) dimer would exist analogous to $(al_2Cl_7)^{31}$ and $(Ga_2Cl_7)^-$, the species that lead to Al and Ga deposition, respectively.

SUMMARY OF THE INVENTION

A method of electrodepositing a film including the steps of immersing a conductive substrate opposite a counterelectrode in an organochloroindate melt comprising a salt of Group V elements of the periodic table including at least one metal selected from the group consisting of phosphorous, arsenic, and antimony, and an $InCl_3$-dialkylimidazolium chloride wherein the alkyl groups each comprise no more than four carbons, and the molar ratio of $InCl_3$ to organic chloride ranges from about 45/55 to §; and cathodizing said substrate at a potential selected to codeposit In and said metal. In addition, substitution of a small amount of $InCl_3$ with a trichloride salt of another Group III metal can be employed to obtain deposits containing other Group III metals. For molar ratios of the $InCl_3$:organic chloride other than 45/55, the melt is heated to 45° C. or greater.

The invention provides the following advantages:

Thin films can be easily electrodeposited, which eliminates the need for grinding or lapping that is currently required to thin commercially available samples to the required thicknesses.

$InCl_3$-ImCl melts allow electrodeposition at relatively low temperatures.

Electrodeposition generally requires low scale-up costs compared to competing methods of deposition such as chemical vapor deposition and molecular beam epitaxy. Fast film growth and the efficient use of chemical precursors are other advantages offered by electrodeposition.

The use of organic chloroindate melts prevents contamination from other metal salts.

DETAILED DESCRIPTION

Unlike $AlCl_3$/ImCl and $GaCl_3$/ImCl melts, the novel $InCl_3$/ImCl melt of the present invention is not liquid at room temperature over a wide mole percent of $InCl_3$. The $InCl_3$/ImCl melt is liquid at room temperature only at composition ratios very near 45:55 (molar ratio of $InCl_3$ to ImCl) and even then it is very viscous. It has been discovered that, in contrast to $GaCl_3$/ImCl melts, an elevated temperature of at least 45° C. is preferred to effect the electrodeposition of In and Sb. The organic chloroindate molten salt is presumably formed by a reaction similar to that of Eq. (1):

$$ImCl + InCl_3 \longleftrightarrow Im^+ + InCl_4^- \quad (2)$$

The presence of $InCl_4^-$ in another (high temperature) molten salt system, $InCl_3$/KCl, has been previously confirmed by Raman spectroscopy.

By analogy with the chloroaluminates, it is expected that both acidic and basic $InCl_3$-ImCl melts can be made by varying the molar ratio of $InCl_3$ to ImCl. Mixtures with ratios greater than one should yield acidic melts due to the presence of excess metal chloride (a Lewis acid), while melts with ratios less than one will yield basic melts. Thus, $InCl_3$-ImCl mixtures with molar ratios of §, 1/1 and 3/2 have been prepared and heated to 65° C. Of these, only the basic melt (§ ratio) formed a clear liquid at this temperature. The others formed cloudy mixtures apparently containing solid particles suspended in a liquid phase. Other basic compositions were investigated and a 45/55 mixture was found to be less viscous than the § composition; it remained liquid even at room temperature.

Figure 1:
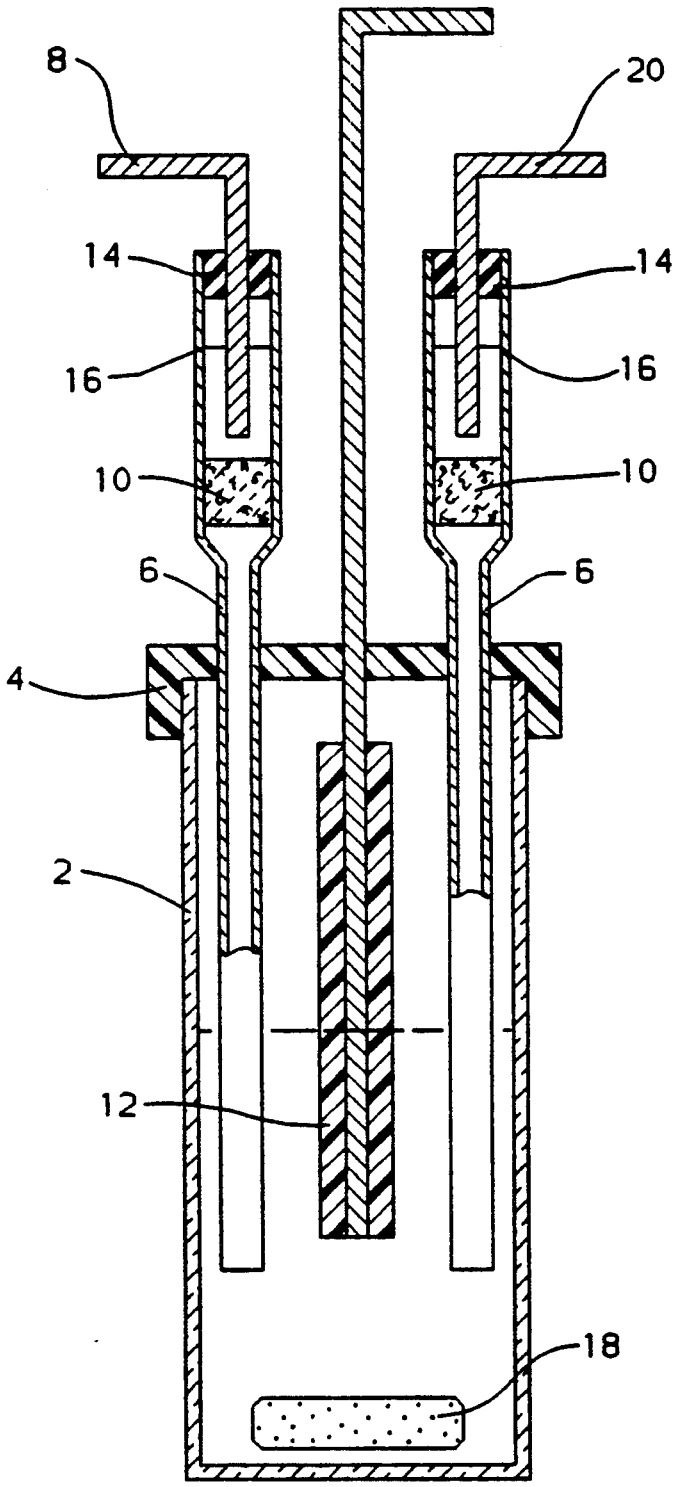
FIG. 1 schematically illustrates the cell used in making the present invention.

Tests were conducted in a cell shown schematically in FIG. 1. The cell comprised a sealed, glass vial 2 having a polytetrafluoroethyene (PTFE) septum 4 sealing off the top of the vial 2. A glass capillary pipette 6 pierced the septum 4 and served as a compartment for an indium reference-electrode 8. Glass wool 10 packed into the lower portion of the compartment impeded electrolyte transfer from the pipette compartment into the vial 2 containing the cathode 12. The electrolyte melt was drawn into the reference-electrode compartment from the vial 2 by means of a syringe having a needle that passed through a gas-tight septum 14 at the top of the pipette 6. The suction created pulled melt from the vial 2 into the reference compartment to a level 16 which did not change during the experiments. The cathode 12 comprised a 0.07-$cm^2$ glassy-carbon disks having an inert chlorofluorocarbon polymer (Kel-F) enshrouding all but an exposed carbon surface. The counterelectrode 20 was constructed identically as the reference electrode 8. A magnetically rotatable Teflon coated bar 18 in the bottom of the vial 2 provided stirring of the melt. The potential between the cathode 12 and reference electrode 8 as well as the power required to pass current between the cathode 12 and the In counterelectrode 20 was provided by a combination potentiostat and galvanostat. An indium-coated platinum wire (1.5-mm diameter) was used as the reference electrode 8 and all potentials reported herein are that of the cathode 12 relative to the reference electrode 8.

1-methyl-3-ethylimidazolium chloride was prepared by reacting ethylene chloride with 1-methylimidazole. The resulting crystals were dissolved in reagent-grade acetonitrile and precipitated in a large excess of reagent-grade ethyl acetate. After vacuum drying the ImCl powder was placed in a sealed vial. Various $InCl_3$-ImCl melts ranging from 0.1 to 9 molar ratio of ImCl to $InCl_3$ were made by adding solid $InCl_3$ to the ImCl powder.

All experiments were conducted in a glove box containing a dry-nitrogen environment and having its escape-gas valve vented to a hood owing to the volatility and toxicity of $SbCl_3$. Following In and Sb deposition, the deposits were characterized by (1) scanning electron micrography; (2) energy dispersive X-ray analysis (EDS) for elemental composition; and (3) X-ray photoelectron spectroscopy (XPS).

Electrodeposition of InSb

The deposition on of In metal from a $InCl_3$-ImCl melt results from the reduction of soluble In species in the melt. The overall reaction is $$In(III) + 3e^- \longleftrightarrow In \quad (3)$$

Figure 2:
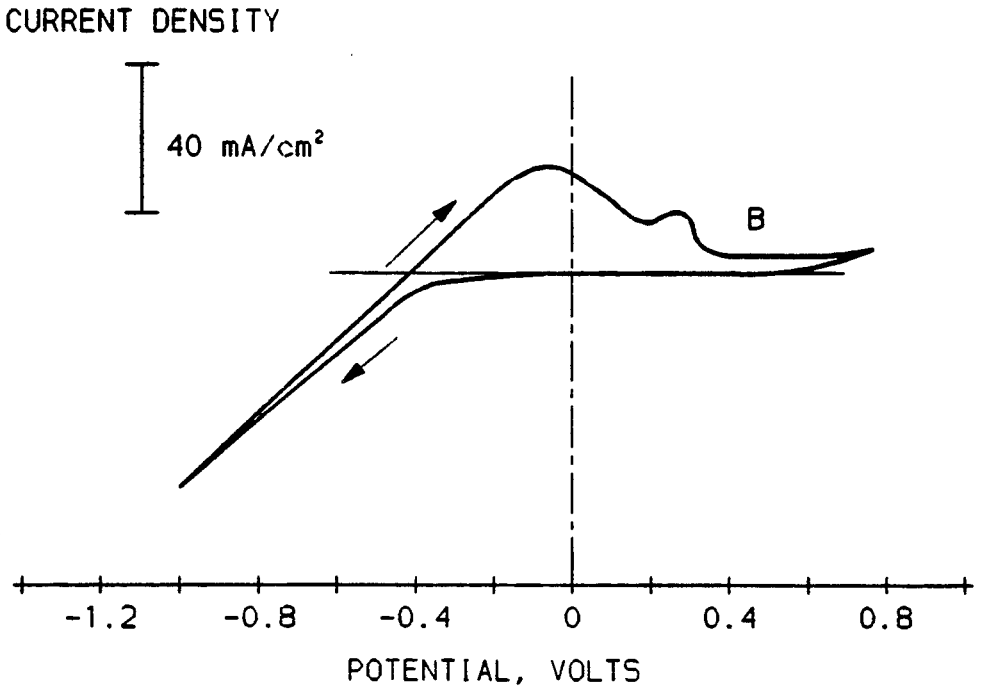
FIG. 2 shows a cyclic voltammogram of chloroindate melt with no Sb.

Evidence of the reduction of In(III) can be seen in FIG. 2 which shows a cyclic voltammogram of the chloroindate melt of 45:55 $InCl_3$/ImCl. In this experiment, the potential of a platinum disk working electrode was repeatedly scanned between −1.0 and +0.8 V (vs. In)

at 100 mV/s. The curve represents the sustained periodic state (i.e., the same voltammogram was observed after repeated cycling). Several electrochemical processes are apparent in the FIGURE; the cathodic current seen at negative potentials corresponds to the reduction of In(III) species, while the anodic peaks at positive potentials suggest the involvement of both In(III) and In(I) species in the oxidative electrochemistry.

The melt used for the electrodeposition of InSb was obtained by adding $SbCl_3$ to the organic chloroindate melt. $SbCl_3$ is soluble in the $InCl_3$-ImCl melt and likely yields, $$Cl^- + SbCl_3 \longleftrightarrow SbCl_4 \quad (4)$$

Figure 3:
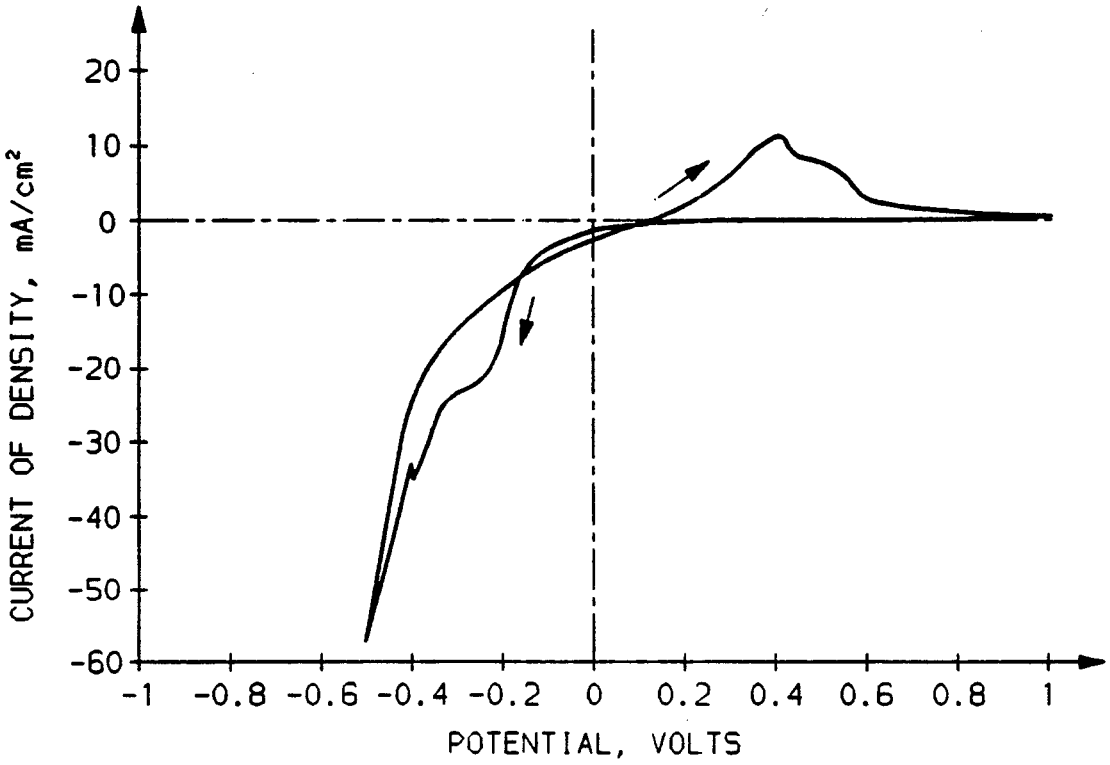
FIG. 3 is a cyclic voltammogram of a $SbCl_3$ and organic chloroindate melt of the present invention.
Figure 4:
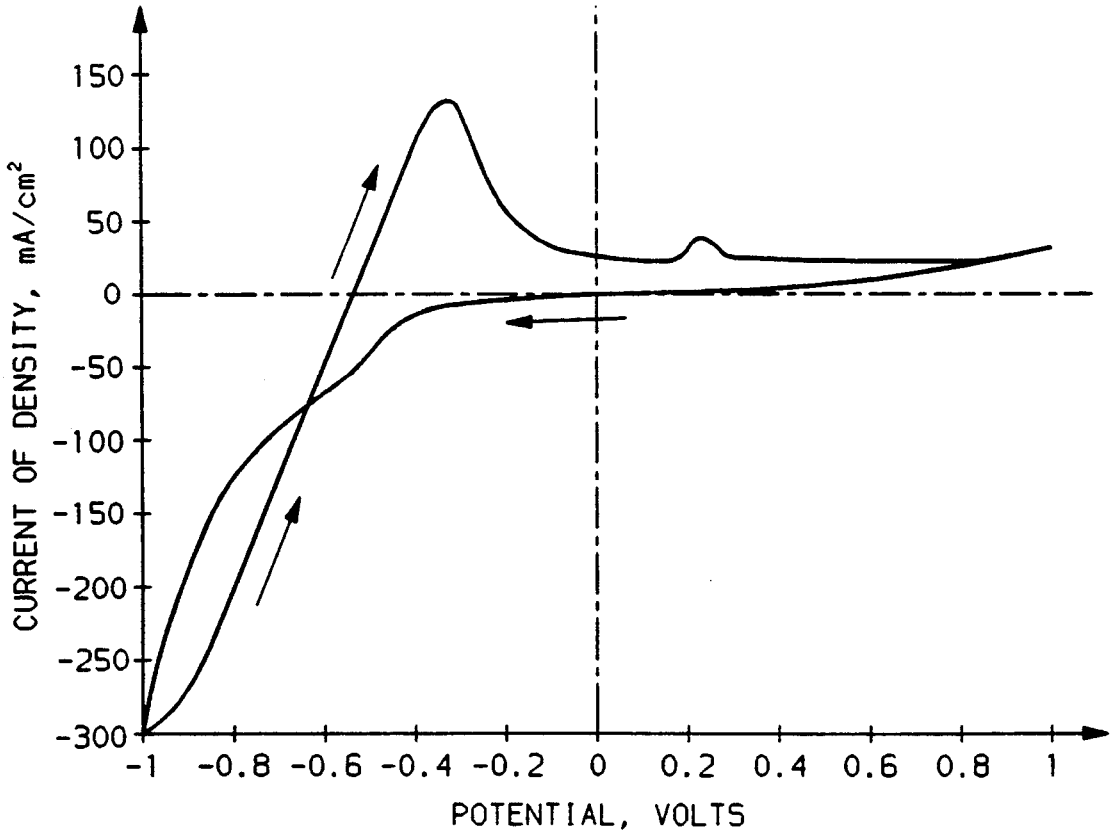
FIG. 4 is a cyclic voltammogram of a $SbCl_3$ and organic chloroindate melt of the present invention.

The Sb(III) concentration was typically maintained at 0.1 M bulk concentration, much lower than that of In(III) in the melt. Representative voltammograms from the Sb-containing melt, obtained with a Pt microcylinder electrode, are shown in FIGS. 3 and 4. The cyclic voltammogram in FIG. 3 is clearly much different in appearance than the voltammogram of the melt with no Sb, shown in FIG. 2. Reduction currents are seen from the Sb-containing melt at potentials between 0 and −0.4 V, while the voltammogram of FIG. 2 shows negligible reduction currents in the same potential region. This reduction current from the Sb-containing melt at potentials positive of the current onset from the melt without Sb, coupled with the obvious differences in appearance of the voltammograms, strongly indicates that the electrochemistry of Sb(III) is largely responsible for the cyclic voltammogram illustrated in FIG. 3.

FIG. 4 illustrates that when the potential is scanned to more negative potentials in the Sb-containing melt, −1.0 V in this case (i.e., between −1.00 and 1.00 V), the voltammogram does resemble that seen for In deposition (i.e., FIG. 2). This is expected since the Sb(III) concentration is too low to alter significantly the electrochemistry of the more abundant In species when large negative potentials are employed. FIGS. 3 and 4 thus strongly suggest that electrochemical codeposition of In and Sb can be made to occur. Further, the composition of the codeposits should be easily controllable by adjustment of either the deposition potential or the reactant concentrations.

EXAMPLE $InCl_3$-ImCl molten salts were formed by mixing ImCl with $InCl_3$ in the desired ratio and heating the mixture, with stirring, to 50–65° C. Melt composition in this example was a 45:55 molar ratio of $InCl_3$ to ImCl. Typical batch sizes ranged from 10 to 20 grams. The resulting molten salt was allowed to equilibrate at 45° C. for at least several hours (typically overnight) before using it as an electrolyte. InSb deposition was accomplished at 45° C. $SbCl_3$ was added, with stirring, to the molten salt electrolyte immediately before deposition. Electrolyte preparation and all electrochemical experiments were done in glass containers in a $N_2$-filled glove box.

A combination potentiostat/galvanostat was used to control potential or current in the 3-electrode electrochemical cell. Both the counter and reference electrodes consisted of indium metal made by dip-coating platinum wires in molten indium. Both electrodes were housed in separate compartments which maintained solution contact with the reservoir in which deposition was done. The compartments consisted of capillary pipettes filled with melt and stoppered with glass wool to minimize diffusion of solution species as described above.

Electrochemical deposition was carried out on both platinum disk electrodes (2 $mm^2$), and glassy carbon disks (7 $mm^2$). Potentials ranging from −0.3 to −1.2 V (vs In reference) were used. One of the most homogeneous deposits was formed using a pulsed-potential; a square-pulse potential source controlled the potential of the working electrode relative to the reference electrode alternating between 0 and −1.2 V with a half-cycle period of 100 ms.

Figure 5:
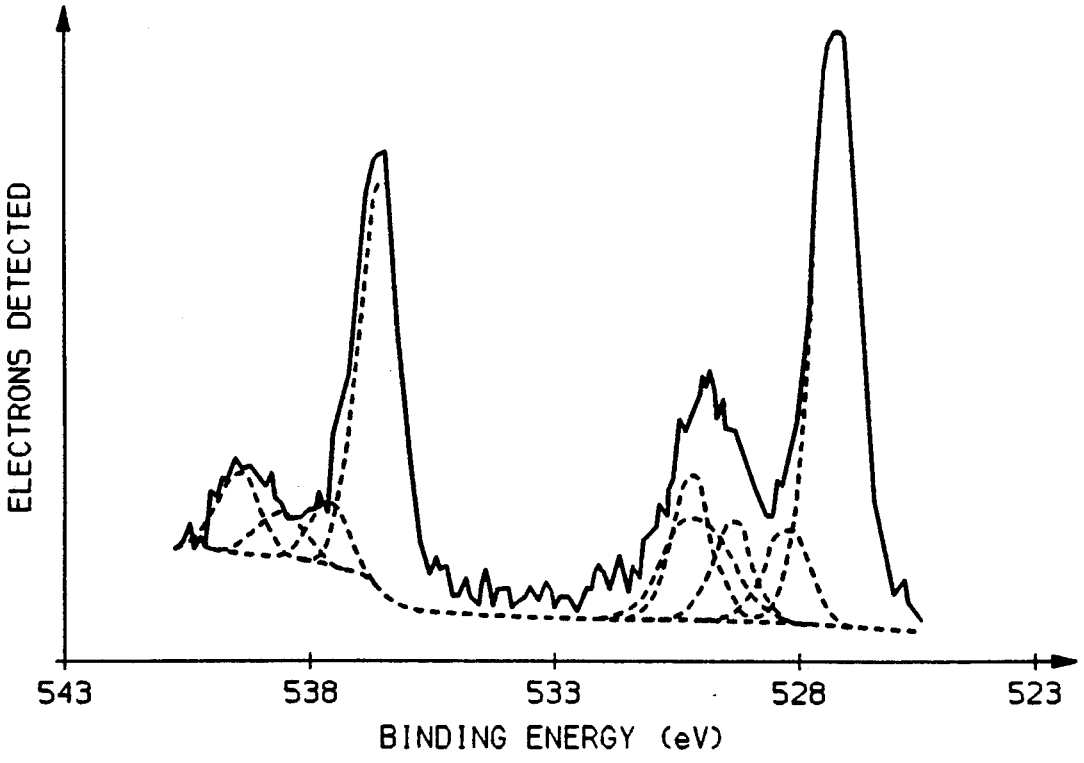
FIG. 5 shows the results of X-ray photoelectron spectroscopic analysis of an In-Sb deposit formed according to the present invention.

The atomic ratios of In to Sb in the deposits, as determined by energy dispersive spectroscopy coupled with scanning electron microscopy, showed a wide range of compositions to be accessible by electrochemical codeposition. Ratios from 14 to 0.7 were obtained. XPS was used to determine the oxidation states of Sb and In in a number of the codeposits and clearly showed the presence of InSb in many of them. FIG. 5 shows a high-resolution XPS spectrum of a sample deposited using the pulsed potential program described above. The portion of the energy spectrum which corresponds to Sb 3d electrons is shown. Peak-fitting analysis of the XPS spectra gave the component peaks shown by the dashed lines. The assignments of these peaks, which are due to Sb, Sb oxides, and InSb, are given in Table I.

TABLE I

| Assignment | Binding Energy (eV) | Sb Species |
|---|---|---|
| Sb $3d_{5/2}$ | 527.4 | InSb |
| Sb $3d_{5/2}$ | 528.4 | Sb(0) |
| Sb $3d_{5/2}$ | 529.5 | $Sb_2O_3$ |
| O 1s | 530.2 | |
| Sb $3d_{5/2}$ | 530.3 | $Sb_2O_5$ |
| Sb $3d_{3/2}$ | 536.7 | InSb |
| Sb $3d_{3/2}$ | 537.7 | Sb(0) |
| Sb $3d_{3/2}$ | 538.8 | $Sb_2O_3$ |
| Sb $3d_{3/2}$ | 539.7 | $Sb_2O_5$ |

The largest peak, at 527.4 eV, is attributed to InSb on the basis of comparison with the reported binding energy for Sb 3d electrons in InSb. XPS spectra of In 3d binding energies show similar results; chemical shifts are consistent with In present as InSb. Semi-quantitative analysis of the data in FIG. 5 indicates that about 67% of the Sb is present in compound InSb, with the rest present as Sb metal and its oxides. This percentage can likely be increased by optimization of the codeposition process In addition, the quality of the deposits can be improved by annealing at relatively low temperatures (350° C.). Such annealing reduces the number of defects and facilitates the reaction of free In and Sb in the deposit to form InSb.

Low-temperature organic chloroindate melts such as $InCl_3$-ImCl can be used as electrolytes for the electrodeposition of indium, antimony, indium antimonide and other indium-containing semiconductors. Electrodeposition can be accomplished in any of a number of cell and electrode configurations which are obvious to those skilled in the art. Electrodeposition can be accomplished either through control of the potential of the substrate electrode or by galvanostatic control. Any conducting material can be used as a substrate electrode. Post-deposition treatments such as annealing can be used to alter the electronic properties of the deposit.

The electrodeposition of InSb should allow the inexpensive fabrication of thin films of this material. Such films might be useful as magnetoresistive sensor elements or as infrared-sensitive detectors.

The embodiments of the invention in which an exclusive property or privilege is claimed are defined as follows:

1. A method of electrodepositing a film comprising: immersing a conductive substrate opposite a counterelectrode in an organochloroindate melt comprising a salt of at least one metal selected from the group consisting of phosphorus, arsenic, and antimony, and an $InCl_3$-dialkylimidazolium chloride wherein the alkyl groups each comprise no more than four carbons, and the molar ratio of $InCl_3$ to organic chloride ranges from about 45/55 to about [illegible]; and cathodizing said substrate at a potential selected to codeposit In and said metal as a film.

2. A method as set forth in claim 1 wherein said metal, is antimony and said film comprises InSb.

3. A method as set forth in claim 2 further comprising the step of annealing said film so that it is magnetoresistive.

4. A method as set forth in claim 2 further comprising the step of annealing said film comprising InSb to increase the concentration of InSb in said film.

5. A method as set forth in claim 1 where said dialkylimidazolium comprises 1-methyl-3-ethylimidazolium.

6. A method as set forth in claim 1 further comprising the step of heating said melt so that said codeposition occurs at about 45° C. or greater.

7. A method as set forth in claim 1 further comprising the step of heating said melt to a temperature ranging from about 45° C. to about 60° C. prior to said cathodizing.

8. A method as set forth in claim 1 wherein said counterelectrode comprises indium.

9. A method as set forth in claim 1 wherein said cathodizing is conducted so that said film has a thickness ranging from about 15 μm to 20 nm.

10. A method as set forth in claim 1 wherein said metal consists essentially of antimony.

11. A method as set forth in claim 10 further comprising the step of annealing said film to produce InSb.

* * * * *